US008279125B2

(12) United States Patent
Bellows

(10) Patent No.: US 8,279,125 B2
(45) Date of Patent: Oct. 2, 2012

(54) COMPACT CIRCULAR POLARIZED MONOPOLE AND SLOT UHF RFID ANTENNA SYSTEMS AND METHODS

(75) Inventor: David E. Bellows, Wantagh, NY (US)

(73) Assignee: Symbol Technologies, Inc., Holtsville, NY (US)

( * ) Notice: Subject to any disclaimer, the term of this patent is extended or adjusted under 35 U.S.C. 154(b) by 403 days.

(21) Appl. No.: 12/643,206

(22) Filed: Dec. 21, 2009

(65) Prior Publication Data

US 2011/0148722 A1 Jun. 23, 2011

(51) Int. Cl.
*H01Q 21/00* (2006.01)

(52) U.S. Cl. ..... 343/725; 343/767

(58) Field of Classification Search ..... 343/725, 343/729, 767, 770
See application file for complete search history.

(56) References Cited

U.S. PATENT DOCUMENTS

| | | | | |
|---|---|---|---|---|
| 6,130,647 | A * | 10/2000 | Zurcher et al. | 343/767 |
| 6,424,309 | B1 | 7/2002 | Johnston et al. | |
| 6,653,983 | B2 * | 11/2003 | Masuda et al. | 343/767 |
| 7,187,337 | B2 * | 3/2007 | Aikawa et al. | 343/767 |
| 7,327,324 | B2 | 2/2008 | Wang et al. | |
| 8,018,389 | B2 * | 9/2011 | Chiang et al. | 343/745 |
| 2007/0085742 | A1 | 4/2007 | Kikin | |
| 2009/0096680 | A1 | 4/2009 | Bellows | |
| 2009/0295567 | A1 | 12/2009 | Bellows | |
| 2011/0140977 | A1 * | 6/2011 | Yang et al. | 343/725 |

* cited by examiner

*Primary Examiner* — Tan Ho
(74) *Attorney, Agent, or Firm* — Terri Hughes Smith; Kenneth A. Haas

(57) ABSTRACT

The present disclosure relates to a combined and compact monopole and slot antenna providing circular polarization for various applications, such as ultra high frequency (UHF) radio frequency identification (RFID). The antenna of the present invention combines a slot antenna with a monopole antenna using a single feed to drive both, effectively resulting in a circular polarized antenna. In an exemplary embodiment, the antenna may be integrated internally to a mobile device and printed on a flex or a printed circuit board (PCB), made from sheet metal, etc. Advantageously, the design of the antenna provides performance similar to circular polarized patch antennas while avoiding the size, weight, and cost.

14 Claims, 4 Drawing Sheets

COMPACT CIRCULAR POLARIZED MONOPOLE AND SLOT UHF RFID ANTENNA SYSTEMS AND METHODS

FIELD OF THE INVENTION

The present invention relates generally to wireless antennas. More particularly, the present invention relates to a combined and compact monopole and slot antenna providing circular polarization for various applications, such as ultra high frequency (UHF) radio frequency identification (RFID).

BACKGROUND OF THE INVENTION

Designing orientation insensitive RFID antennas has always been a significant challenge of any RFID antenna development effort, especially for handheld products. Linear polarized antennas are not as accepted anymore, because end users want to be able to read an RFID tag in any orientation without having to rotate his/her wrist to align the RFID antenna's polarization with the RFID tag. Conventional solutions have responded by delivering circular polarized antennas, but conventional offerings typically include large, heavy, expensive, and fragile patch antennas. Another solution has been to design two orthogonally polarized antennas running them both and switching between the two. This concept does address the orientation sensitivity but at the expense of complexity, cost, and size; two cables are required (double the cost of a single cable), isolation between the cables is required, two baluns and matching circuits are required, and additional hardware and software are required to control the two antennas. Disadvantageously, conventional circular polarized patch antennas are physically heavy and require multiple parts, including fragile dielectric material. Further, for portable mobile devices such as RFID readers, conventional circular polarized patch antennas typically do not conform to the housing's shape of the mobile devices.

BRIEF SUMMARY OF THE INVENTION

In an exemplary embodiment of the present invention, a circular polarized antenna includes a monopole antenna; a ground plane; and a slot antenna formed through a slot disposed between the monopole antenna and the ground plane. The monopole antenna may be one of vertically polarized or horizontally polarized and the slot antenna may be one of vertically polarized or horizontally polarized opposite from the monopole antenna thereby combined in a single antenna to provide the circular polarized antenna. The circular polarized antenna may further include a common feed driving each of the monopole antenna and the slot antenna. The common feed may drive each of the monopole antenna and the slot antenna out of phase from one another by ninety degrees. Optionally, the common feed may be connected symmetrically to the slot. Alternatively, the common feed may be connected asymmetrically to the slot. The slot may include a first slot, a second slot, and a third slot. The slot may include a U shape with the first slot open at one end and connected to the second slot at another end, the second slot connected to the first slot at one end and the third slot at another end, and the third slot connected to the second slot at one end and open at another end. Optionally, the common feed may be connected substantially in a center of the second slot and to the monopole antenna. The circular polarized antenna may further include a capacitor at the open end of the first slot. Alternatively, the open end of the first slot may be wider than the open end of the third slot. The common feed may be connected asymmetrically off a center of the second slot and to the monopole antenna. Each of the monopole antenna, the ground plane, and the slot antenna may be printed on one of a printed circuit board, a flex, sheet metal, or an electrically conductive surface. The circular polarized antenna may operate at ultra high frequencies for radio frequency identification. The monopole antenna and the slot antenna may include substantially orthogonal polarizations in a single structure thereby providing circular polarization.

In another exemplary embodiment of the present invention, a method includes providing a monopole antenna; providing a ground plane for the monopole antenna; forming a slot between the ground plane and the monopole antenna, the slot forming a slot antenna; providing a common feed to each of the monopole antenna and the slot antenna such that the common feed is out of phase between the monopole antenna and the slot antenna by ninety degrees; and operating the monopole antenna and the slot antenna as a single circular polarized antenna. The method may further include varying the geometry of the slot and the monopole antenna based on application requirements.

In yet another exemplary embodiment of the present invention, a circular polarized slot/monopole antenna includes a ground plane adjacent to a conductive surface, wherein the conductive surface includes a monopole antenna; a slot formed between the ground plane and the conductive surface, wherein the slot includes a slot antenna; and a common feed connected to each of the slot and the conductive surface, wherein the common feed is configured to drive each of the monopole antenna and the slot antenna out of phase with respect to one another by ninety degrees; wherein the monopole antenna is one of vertically polarized or horizontally polarized and the slot antenna is one of vertically polarized or horizontally polarized opposite from the monopole antenna thereby combined in a single antenna to provide the circular polarized antenna. Optionally, the slot may include a first slot, a second slot, and a third slot; and wherein the slot may include a U shape with the first slot open at one end and connected to the second slot at another end, the second slot connected to the first slot at one end and the third slot at another end, and the third slot connected to the second slot at one end and open at another end.

BRIEF DESCRIPTION OF THE DRAWINGS

The present invention is illustrated and described herein with reference to the various drawings of exemplary embodiments, in which like reference numbers denote like system components and/or method steps, respectively, and in which.

DETAILED DESCRIPTION OF THE INVENTION

In various exemplary embodiments, the present invention relates to a combined and compact monopole and slot antenna providing circular polarization for various applications, such as ultra high frequency (UHF) radio frequency identification (RFID). The antenna of the present invention combines a slot antenna with a monopole antenna using a single feed to drive both, effectively resulting in a circular polarized antenna. In an exemplary embodiment, the antenna may be integrated internally to a mobile device and printed on a flex or a printed circuit board (PCB), made from sheet metal, or any other electrically conductive surface. Advantageously, the design of the antenna provides performance similar to circular polarized patch antennas while avoiding the size, weight, and cost.

Figure 1:
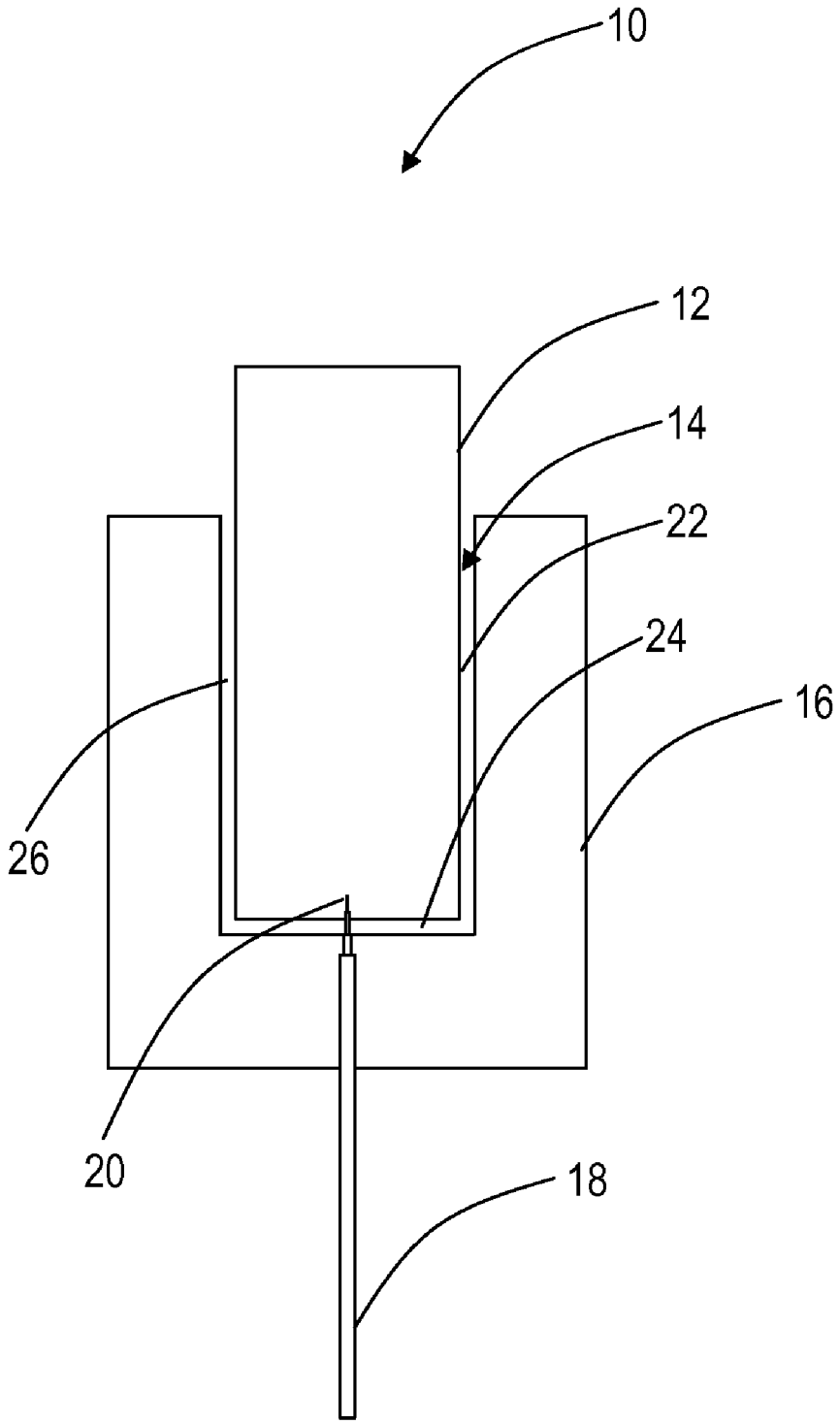
FIG. 1 is a diagram illustrating a compact, circular polarized monopole and slot antenna with a single common cable feed according to an exemplary embodiment of the present invention.

Referring to FIG. 1, in an exemplary embodiment, a circular polarized monopole/slot antenna 10 is illustrated. The monopole/slot antenna 10 includes a vertically polarized monopole antenna 12, a horizontally polarized slot antenna 14, a ground plane 16, and a single cable 18 with a common feed 20. The vertically polarized monopole antenna 12 is disposed within an opening in the ground plane 16 to form the horizontally polarized slot antenna 14. The present invention references that the monopole antenna 12 is vertically polarized and the slot antenna 14 is horizontally polarized. Is it understood by those of ordinary skill in the art that by simply rotating the geometry by ninety degrees, the monopole antenna 12 would instead be horizontally polarized and the slot antenna 14 would be vertically polarized. Thus, the monopole antenna 12 and slot antenna 14 have substantially orthogonal polarizations and that by combining the two into one structure, circular polarization results.

The slot antenna 14 may be shaped substantially like the letter "U" with a first slot 22, a second slot 24, and a third slot 26. Specifically, each of the slots 22, 24, 26 may be formed by cutting a shape in a conductive material. The first slot 22 and the third slot 26 may be two substantially equal length channels that are connected via the second slot 24 which receives the feed 20. Note, the first slot 22 and the third slot 26 are each open-ended at both ends of the ground plane 16. By cutting these slot 22, 24, 26 shapes in the conductive material, the remaining material may form the monopole antenna's "whip" 12 with ground plane 16 that use the same feed 20 as the slot antenna 14. One side of the slots 22, 24, 26 becomes the monopole's counterpoise, while the other side forms the monopole's "whip." The geometry of this monopole creates a vertically polarized antenna.

The single cable 18 provides a common feed 20 from a radio frequency (RF) module (not shown). The common feed 20 is configured to drive both the monopole antenna 12 and the slot antenna 14 ninety degrees out of phase from one another resulting in one integrated antenna, i.e. the circular polarized monopole/slot antenna 10. The cable 18 may include a coaxial cable from the RF module with outside insulation, copper mesh, insulation, and copper wire. Of note, the cable 18 and the common feed 20 carry RF signals for both the monopole antenna 12 and the slot antenna 14. Thus, collectively the monopole antenna 12 and the slot antenna 14 may read RFID tags in any polarization, i.e. horizontal, vertical, and anything in between. Scaling the design smaller will result in a tighter bandwidth and lower efficiency for targeted applications, and scaling the design larger yields broad bandwidth and higher efficiency for high end applications.

The circular polarized monopole/slot antenna 10 may be integrated internally into a mobile device, such as a UHF RFID reader. The antenna 10 combines the monopole antenna 12 and the slot antenna 14 to form a single, integrated circularly polarized antenna 10. In an exemplary embodiment, the monopole/slot antenna 10 may be a planar configuration on a PCB or flex with the ground plane 16 including a copper layer. The monopole antenna 12 may include a metal plate, copper tape, or the like on the PCB with the slot antenna 14 including a cut out portion between the monopole antenna 12 and the ground plane 16. When the monopole antenna 12 is driven as an antenna by a driving frequency, the slot 14 also radiates electromagnetic waves. The shape and size of the slot, as well as the driving frequency, determine the radiation distribution pattern.

By maximizing the antenna's 10 performance to a simple geometry and a minimum number of parts, the circular polarized monopole/slot antenna 10 design lends itself to numerous product lines, ranging from larger fixed RFID readers to smaller handheld RIFD readers and modules. This can allow smaller, compact readers/modules with the circular polarized monopole/slot antenna 10 to provide similar performance to conventional circular polarized handheld RFID readers, achieving this similar performance in a lighter, smaller, less expensive product. Further, the present invention may also be well suited for new RFID products, such as wearables, RFID accessories, etc. The design is versatile and scalable to meet a variety of performance and physical requirements. The simplicity of the antenna 10 disclosed here lends itself for easy assembly and implementation, resulting in a well-balanced and engineered product.

Figure 2:
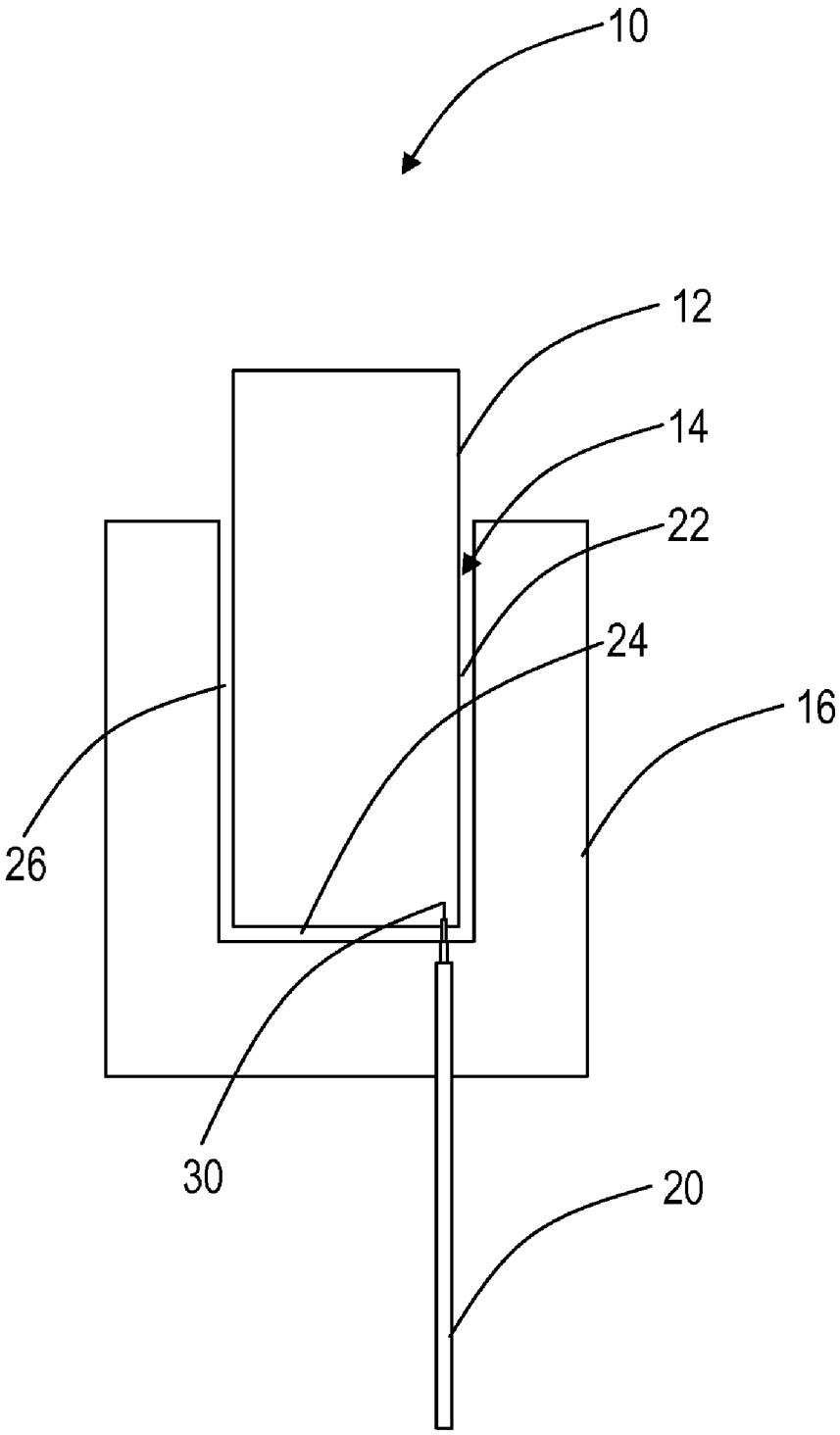
FIG. 2 is a diagram illustrating a compact, circular polarized monopole and slot antenna with a single asymmetric common cable feed according to an exemplary embodiment of the present invention.

Referring to FIG. 2, in another exemplary embodiment, a circular polarized monopole/slot antenna 10 with an asymmetric common feed 30 is illustrated. FIG. 1 illustrated the circular polarized monopole/slot antenna 10 with the common feed 20 in the center of the slot 24. In another exemplary embodiment, the monopole/slot antenna 10 may use the asymmetric common feed 30 to provide for improvements in impedance matching. Here, the asymmetric common feed 30 is connected off-center in the slot 24 and simultaneously (and ninety degrees out-of-phase) to the monopole antenna 24.

Figure 3:
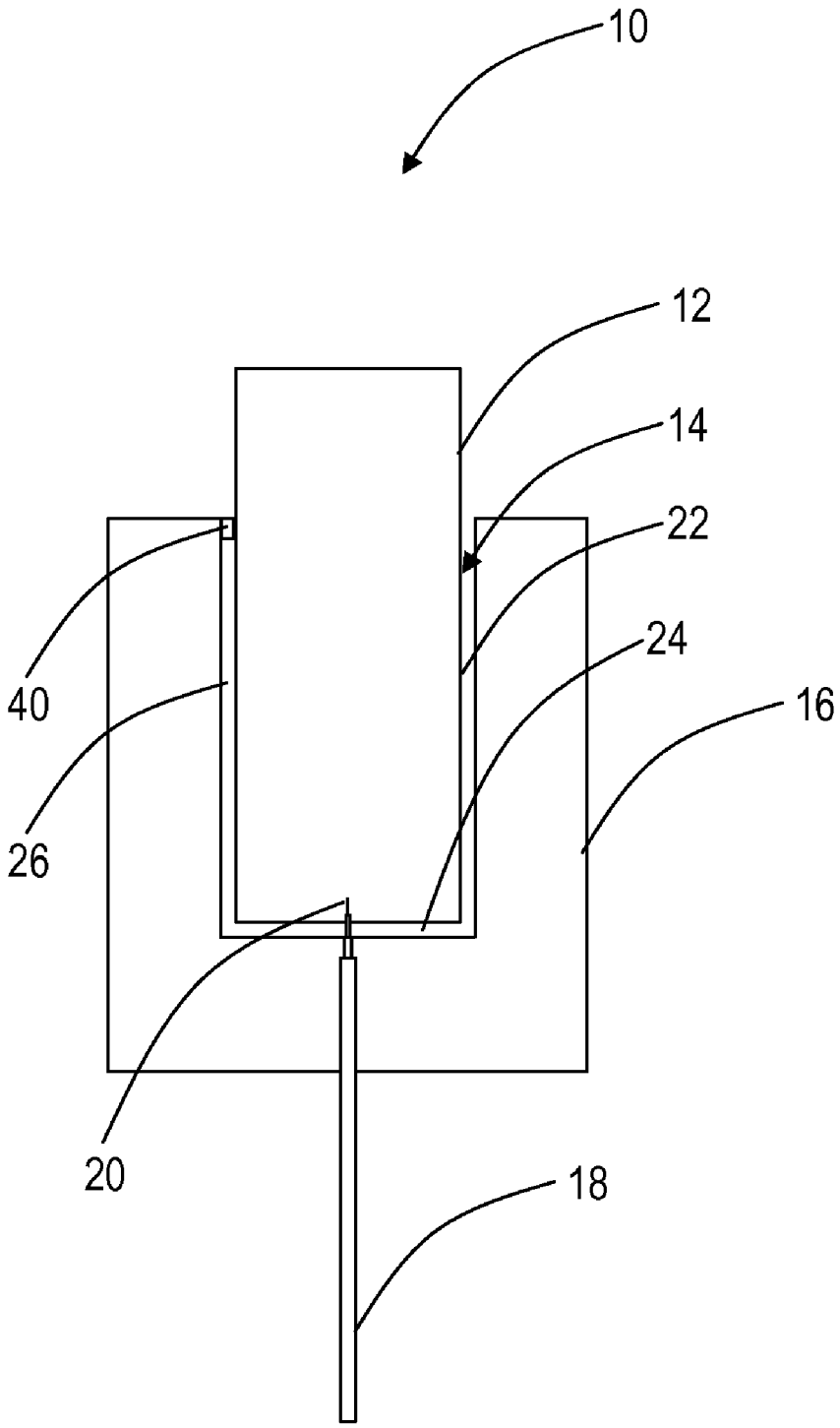
FIG. 3 is a diagram illustrating a compact, circular polarized monopole and slot antenna with a single common cable feed and a capacitor at an end of one of the slots according to an exemplary embodiment of the present invention.

Referring to FIG. 3, in another exemplary embodiment, there are other techniques that have the same effect as the asymmetric common feed 30. For example, the cable can be moved back to the center of the slot if a different asymmetry is introduced. For example, in FIG. 3, this asymmetry can be as straightforward as modifying the capacitance at one end of the slot. This can be done by a number of methods, such as placing a capacitor 40 across one of the slot's 26 ends or by changing the width of the slots 24, 26 at one end. In another exemplary embodiment, the asymmetry may include making the slots 24, 26 unequal lengths.

Figure 4:
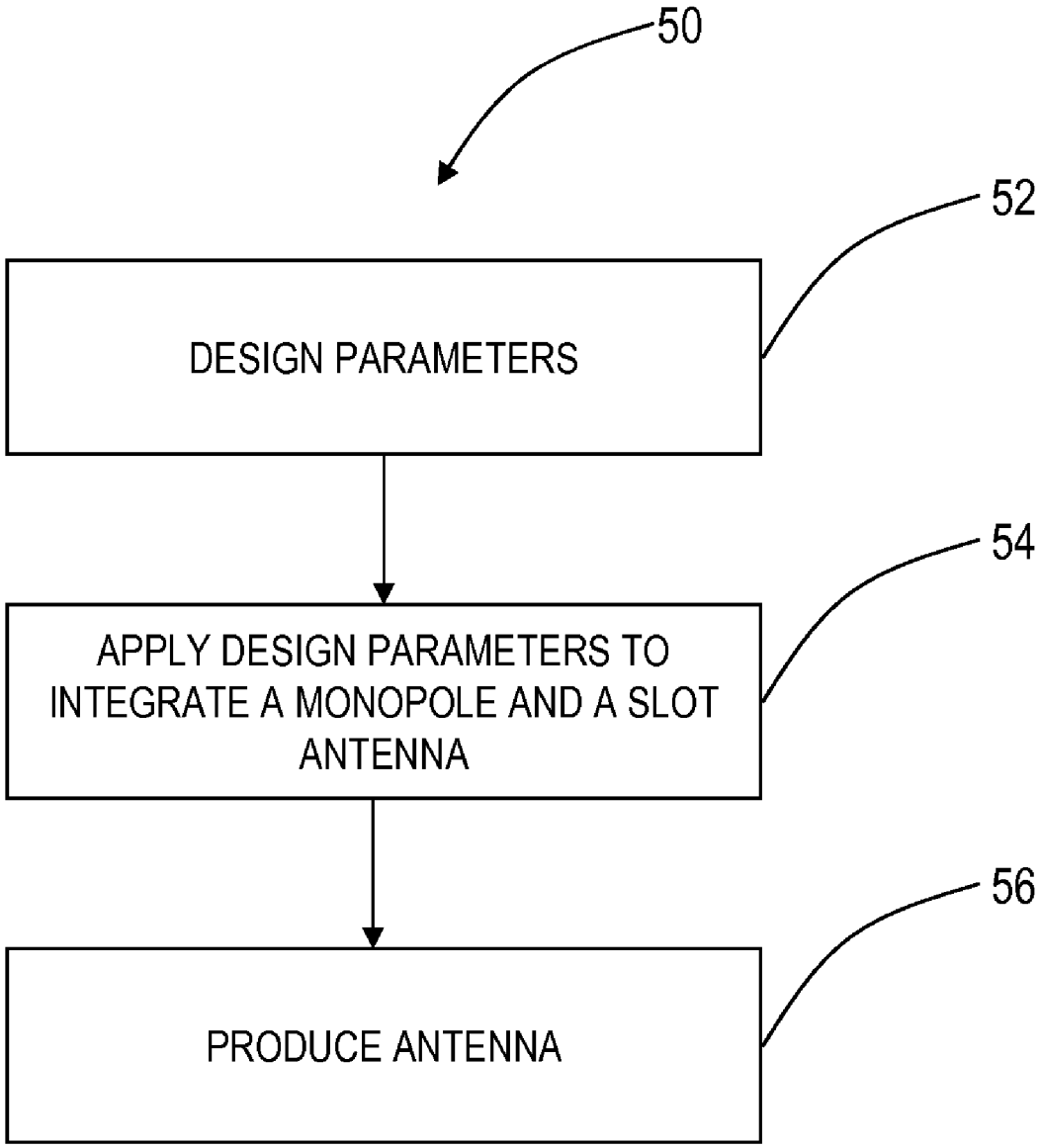
FIG. 4 is a flowchart illustrating a method for designing and realizing a compact, circular polarized monopole/slot antenna according to an exemplary embodiment of the present invention.

Referring to FIG. 4, in an exemplary embodiment, a flowchart illustrates a method 50 for designing and realizing a circular polarized monopole/slot antenna 10. Variations of this basic geometry of the circular polarized monopole/slot antenna 10 in FIGS. 1-3 will yield similar results. As described herein, the monopole/slot antenna 10 combines a monopole and a slot antenna to provide a single, integrated circular polarized antenna. Initially, design parameters are ascertained (step 52). One exemplary application of the monopole/slot antenna 10 includes mobile devices, such as RFID readers. Exemplary design parameters may include operational bandwidth, physical size, power, range, mobile device housing, and the like. For example, a typical RFID UHF frequency band includes 902 MHz-928 MHz. Further, power may be constrained based on power available in a mobile device.

As such, the required design parameters are applied to integrate a monopole antenna and a slot antenna in a combined antenna providing circular polarization (step 54). Here, there may be many changes or variations to the basic geometry illustrated herein for the circular polarized monopole/slot antenna 10 in FIGS. 1-3. A primary variation may involve adjusting the monopole's length and the slot's length (a longer length resonates at a lower frequency and a shorter length resonates at a higher frequency). Making other physical changes may also affect the electrical length, such as meandering the path of the slot to achieve longer length or adding a "top hat" or T-shape cross member to the top of the monopole, which adds capacitance and thereby adds electrical length. Thus, the present invention contemplates geometric variations to the generic monopole and slot shapes shown in the FIGS. 1-3 to achieve proper antenna tuning and matching (or to conform to the product's geometric constraints). Finally, the method 50 may include physical production of the antenna, such as a printing on a PCB or flex.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention and are intended to be covered by the following claims.

What is claimed is:

1. A circular polarized antenna, comprising:

a monopole antenna;

a ground plane; and a slot antenna formed through a slot disposed between the monopole antenna and the ground plane;

wherein the monopole antenna is one of vertically polarized or horizontally polarized and the slot antenna is one of vertically polarized or horizontally polarized opposite from the monopole antenna thereby combined in a single antenna to provide the circular polarized antenna;

wherein the slot comprises a first slot, a second slot, and a third slot;

wherein the slot comprises a U shape with the first slot open at one end and connected to the second slot at another end, the second slot connected to the first slot at one end and the third slot at another end, and the third slot connected to the second slot at one end and open at another end.

2. The circular polarized antenna of claim 1, further comprising:

a common feed driving each of the monopole antenna and the slot antenna.

3. The circular polarized antenna of claim 2, wherein the common feed drives each of the monopole antenna and the slot antenna out of phase from one another by ninety degrees.

4. The circular polarized antenna of claim 3, wherein the common feed is connected symmetrically to the slot.

5. The circular polarized antenna of claim 3, wherein the common feed is connected asymmetrically to the slot.

6. The circular polarized antenna of claim 1, further comprising:

a common feed driving each of the monopole antenna and the slot antenna, wherein the common feed drives each of the monopole antenna and the slot antenna out of phase from one another by ninety degrees.

7. The circular polarized antenna of claim 6, wherein the common feed is connected substantially in a center of the second slot and to the monopole antenna.

8. The circular polarized antenna of claim 7, further comprising:

a capacitor at the open end of the first slot.

9. The circular polarized antenna of claim 7, wherein the open end of the first slot is wider than the open end of the third slot.

10. The circular polarized antenna of claim 6, wherein the common feed is connected asymmetrically off a center of the second slot and to the monopole antenna.

11. The circular polarized antenna of claim 6, wherein each of the monopole antenna, the ground plane, and the slot antenna are printed on one of a printed circuit board, a flex, sheet metal, or an electrically conductive surface.

12. The circular polarized antenna of claim 6, wherein the circular polarized antenna operates at ultra high frequencies for radio frequency identification.

13. The circular polarized antenna of claim 1, wherein the monopole antenna and the slot antenna comprise substantially orthogonal polarizations in a single structure thereby providing circular polarization.

14. A circular polarized slot/monopole antenna, comprising:

a ground plane adjacent to a conductive surface, wherein the conductive surface comprises a monopole antenna;

a slot formed between the ground plane and the conductive surface, wherein the slot comprises a slot antenna; and a common feed connected to each of the slot and the conductive surface, wherein the common feed is configured to drive each of the monopole antenna and the slot antenna out of phase with respect to one another by ninety degrees;

wherein the monopole antenna is one of vertically polarized or horizontally polarized and the slot antenna is one of vertically polarized or horizontally polarized opposite from the monopole antenna thereby combined in a single antenna to provide the circular polarized antenna;

wherein the slot comprises a U shape with the first slot open at one end and connected to the second slot at another end, the second slot connected to the first slot at one end and the third slot at another end, and the third slot connected to the second slot at one end and open at another end.

* * * * *